US007878867B2

(12) United States Patent
Lin

(10) Patent No.: US 7,878,867 B2
(45) Date of Patent: Feb. 1, 2011

(54) ELECTRICAL CONTACT HAVING AN UPPER CONTACT WITH A THICKENED BASE PORTION

(75) Inventor: Chun-Fu Lin, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/754,541

(22) Filed: Apr. 5, 2010

(65) Prior Publication Data

US 2010/0255733 A1 Oct. 7, 2010

(30) Foreign Application Priority Data

Apr. 3, 2009 (TW) ..... 98205418 U

(51) Int. Cl.
*H01R 13/24* (2006.01)

(52) U.S. Cl. ..... 439/700; 439/66

(58) Field of Classification Search ..... 439/786, 439/788, 66, 700, 824, 482, 841
See application file for complete search history.

(56) References Cited

U.S. PATENT DOCUMENTS

| | | | | |
|---|---|---|---|---|
| 7,025,602 | B1 * | 4/2006 | Hwang | 439/66 |
| 7,467,952 | B2 * | 12/2008 | Hsiao et al. | 439/66 |
| 7,520,754 | B1 * | 4/2009 | Gattuso | 439/66 |
| 7,559,806 | B2 * | 7/2009 | Lin et al. | 439/700 |

* cited by examiner

*Primary Examiner*—Javaid Nasri
(74) *Attorney, Agent, or Firm*—Andrew C. Cheng; Wei Te Chung; Ming Chieh Chang

(57) ABSTRACT

An electrical contact (100) comprises an upper contact (1), a lower contact (3) and a spring (2) located between the upper contact (1) and the lower contact (3), the upper contact (1) comprises a base portion (11) and an additional portion (15) bending from the base portion (11) and overlapping each other, the base portion (11) has a first contact portion (111) at a top end thereof, the lower contact (3) comprises a body portion (32) and a pair of arms (33) extending from the body portion (32), the body portion (32) has a second contact portion (321) at a bottom end thereof, the arms (33) contact with the base portion (11) and the additional portion (15).

1 Claim, 5 Drawing Sheets

ELECTRICAL CONTACT HAVING AN UPPER CONTACT WITH A THICKENED BASE PORTION

BACKGROUND OF THE INVENTION

1. Field of the Invention

The present invention relates to an electrical contact, and more particularly, to an electrical contact having an upper contact with an additional portion to enlarge the base portion thereof.

2. Description of the Prior Art

An conventional electrical contact is used to electrically connecting a Central Processing Unit (CPU) with a Printed Circuit Board (PCB). The electrical contact comprises an upper contact, a lower contact and a spring between the upper contact and the lower contact. The upper contact comprises a flat base portion with a first contact portion at the top end. The lower contact comprises a flat body portion and a pair of arm portions extending upwardly from the body portion. The bottom end of the body portion has a second contact portion. The base portion is sandwiched between arms and the arms can move along the base portion.

When the CPU presses the upper contact, the upper contact moves downwardly and presses the spring, the arms moves along the base portion of the upper contact and contacts with the base portion all along. When the CPU is removed, the elastic force of the spring will push the upper contact move upwardly to the initial stage. The upper contact is made of sheet material and the thickness of the base portion is small. Thus, the distance of the pair of arms is small to ensure the connection with the base portion. Therefore, this type of lower contact is difficult to manufacture.

In view of the above, a new electrical contact that overcomes the above-mentioned disadvantages is desired.

SUMMARY OF THE INVENTION

Accordingly, an object of the present invention is provide an electrical contact having improved arrangements between an upper contact and a lower contact thereof.

To fulfill the above-mentioned object, an electrical contact comprises an upper contact, a lower contact and a spring located between the upper contact and the lower contact pushing both from each other, the upper contact comprises a base portion and an additional portion bending from the base portion and overlapping each other, the base portion has a first contact portion at a top end thereof, the lower contact comprises a body portion and a pair of arms extending from the body portion, the body portion has a second contact portion at a bottom end thereof, the arms contact with the base portion and the additional portion.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
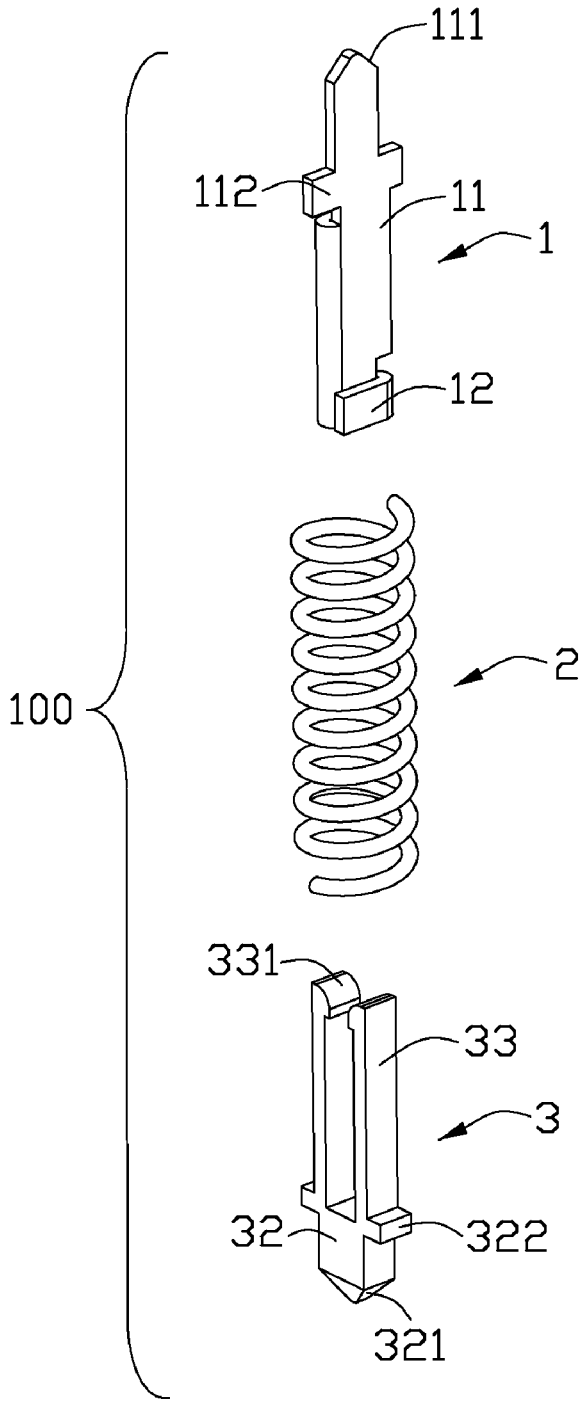
FIG. 1 is an exploded view of an electrical contact in accordance with a preferred embodiment of the present invention.
Figure 2:
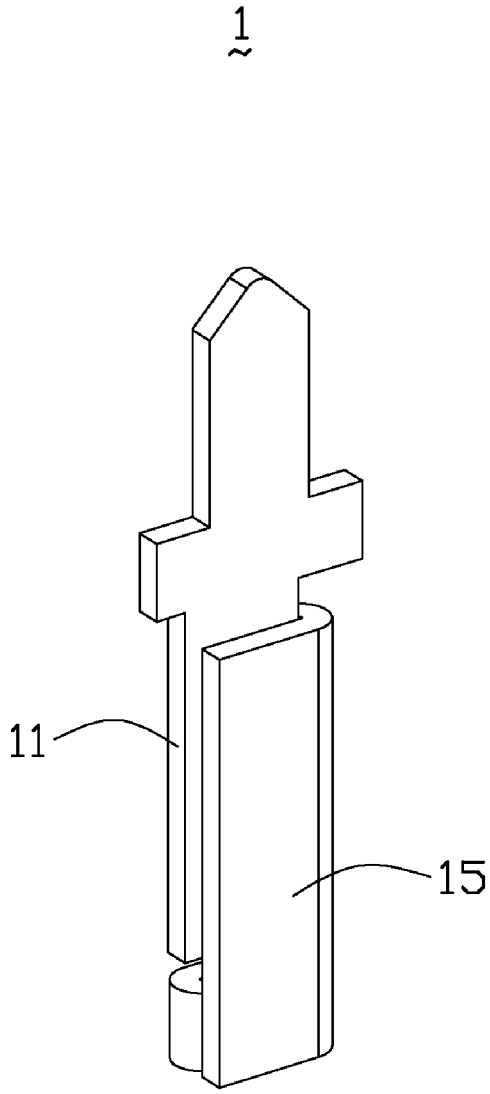
FIG. 2 is an isometric view of the upper contact shown in FIG. 1.

Referring to FIGS. 1-2, the electrical contact 100 is used to electrically connecting a Central Processing Unit (CPU) (not shown) with a Printed Circuit Board (PCB) (not shown). The electrical contact 100 comprises an upper contact 1, a lower contact 3 and a spring 2 located between the upper contact 1 and the lower contact 3.

The upper contact 1 comprises a flat base portion 11, a stop portion 12 bending from one side of the base portion 11 and a flat additional portion 15 bending from the other side of the base portion 11. The stop portion 12 is located at the bottom end of the base portion 11. The width of the additional portion 15 is approximately equal to that of the base portion 11. The stop portion 12 and the additional portion 15 are located at the two sides of the base portion 11 and paralleled to each other. The upper end of the base portion 11 has a first contact portion 111 for contacting with the CPU. A pair of restrict portions 112 extends horizontally from the sides of the base portion 11 and located over the additional portion 15.

The lower contact 3 comprises a flat body portion 32 and a pair of arms 33 extending upwardly from the body portion 32. The body portion 32 has a second contact portion 321 at a bottom end thereof for contacting with the PCB. A pair of support portions 322 extends horizontally from opposite sides of the body portion 32. The pair of arms 33 each has a hook portion 31 extending towards each other.

Figure 3:
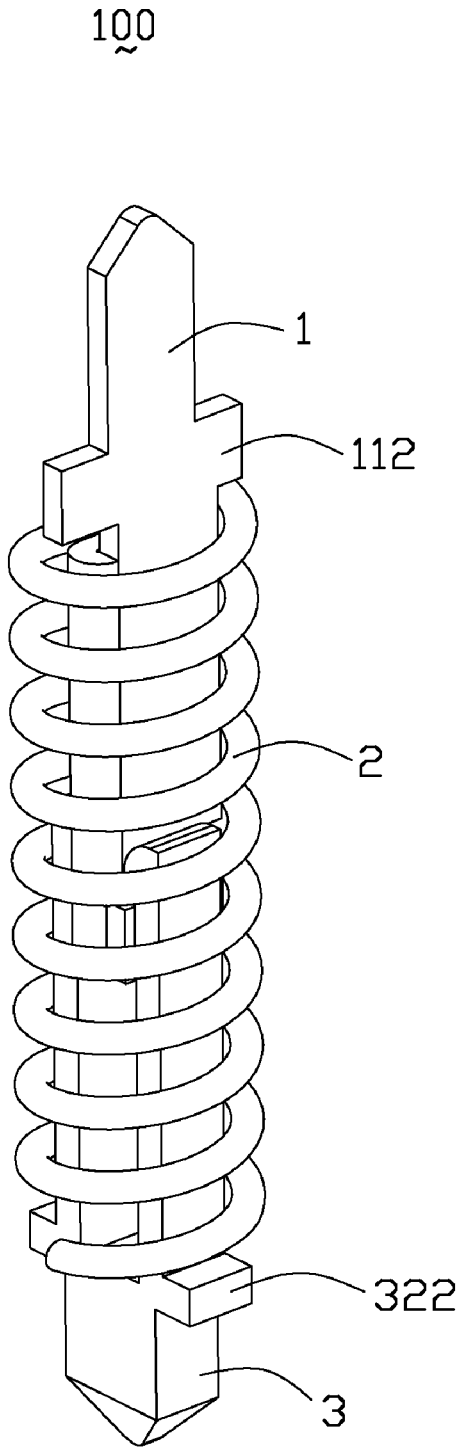
FIG. 3 is an assembled view of the electrical contact shown in FIG. 1.
Figure 4:
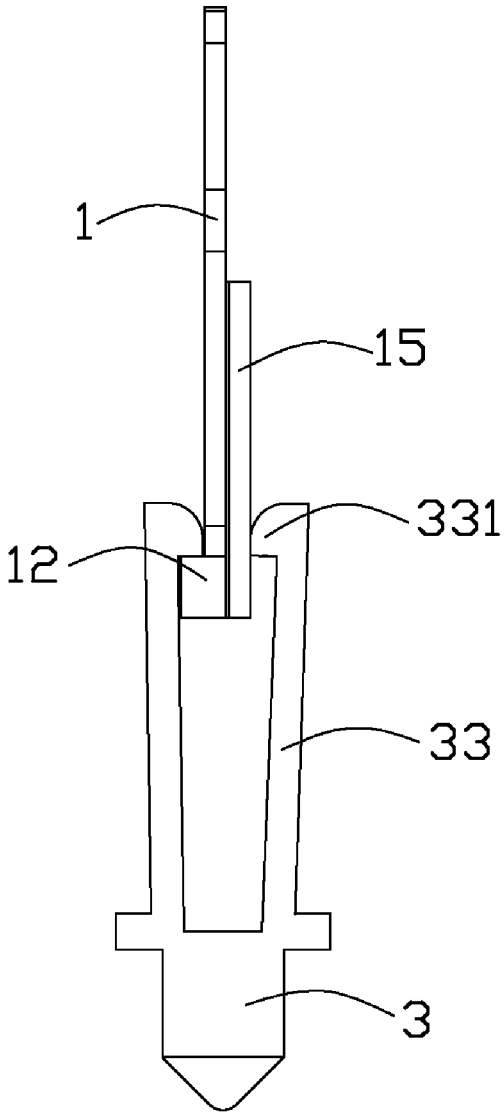
FIG. 4 is an assembled view of the upper contact and the lower contact shown in FIG. 1, showing the upper contact and the lower contact in the initial position.

Please referring to FIGS. 3-4, after the electrical contact 100 is assembled, one hook portion 331 is connected with the base portion 11 and interlocked with the stop portion 12, and the other hook portion 331 is connected with the additional portion 15. The spring 2 is located between the restrict portions 112 and the support portions 322 to restrict the spring 2 between the upper contact 1 and the lower contact 3.

Figure 5:
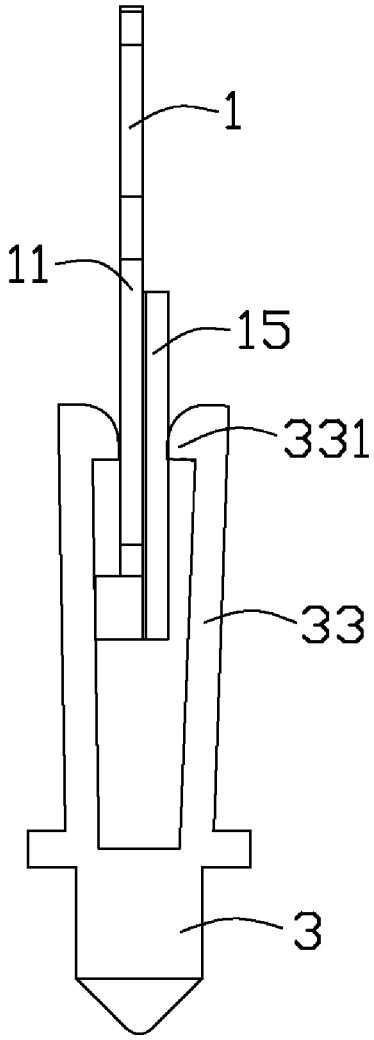
FIG. 5 is similar to FIG. 4, showing the upper contact and the lower contact are pressed.

Please referring to FIG. 5, when the CPU presses the upper contact 1, the upper contact 1 moves downwardly and press the spring 2, the hook portions 331 move along the base portion 11 and the additional portion 15. When the CPU is removed, the upper contact 1 moves upwardly due to the elastic force of the spring 2 to the initial stage. Thus, the electrical contact 100 makes a good electrical connection between the CPU and the PCB.

The upper contact 1 comprises an additional portion 15, so that the pair of arms 33 contact with the base portion 11 and the additional portion 15 respectively, so the distance between the pair of arms 33 are added. Thus, the lower contact 3 is easy to be manufactured and can prevent the disconnection between the hooks 331 and the base portion 11.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical contact comprising:

an upper contact comprising a base portion and an additional portion bending from the base portion and overlapping each other, the base portion having a first contact portion at a top end thereof;

a lower contact comprising a body portion and a pair of arms extending from the body portion, the body portion having a second contact portion at a bottom end thereof, the arms contacting with the base portion and the additional portion respectively; and a spring located between the upper contact and the lower contact;

wherein the additional portion is paralleled with the base portion;

wherein there is a stop portion extending from a bottom end of the base portion and paralleled with the base portion;

wherein the arms each having a hook portion extending towards each other;

wherein the hook portions contact with the base portion and the additional portion respectively;

wherein one of the hook portions interlocks with the stop portion;

wherein a pair of restrict portions extend horizontally from opposite sides of the base portion at an upper end thereof;

wherein a pair of support portions extend horizontally from opposite sides of the body portion and the spring is restricted between the restrict portion and the support portions.

* * * * *